US011585530B2

(12) United States Patent
Ball, IV et al.

(10) Patent No.: US 11,585,530 B2
(45) Date of Patent: Feb. 21, 2023

(54) CLEAN BURNING GAS FLARE TIP

(71) Applicant: Vaprox LLC, Mineral Wells, TX (US)

(72) Inventors: Will Dexter Ball, IV, Bixby, OK (US); Tom Hinkle, Mineral Wells, TX (US)

(73) Assignee: Vaprox LLC, Mineral Wells, TX (US)

( * ) Notice: Subject to any disclaimer, the term of this patent is extended or adjusted under 35 U.S.C. 154(b) by 0 days.

(21) Appl. No.: 16/409,459

(22) Filed: May 10, 2019

(65) Prior Publication Data

US 2020/0355367 A1 Nov. 12, 2020

(51) Int. Cl.
*F23G 7/08* (2006.01)

(52) U.S. Cl.
CPC ..... *F23G 7/085* (2013.01); *F23G 2201/70* (2013.01); *F23K 2400/10* (2020.05)

(58) Field of Classification Search
CPC ..... F23G 7/085
See application file for complete search history.

(56) References Cited

U.S. PATENT DOCUMENTS 3,429,645 A 2/1969 Reed
4,105,394 A 8/1978 Reed et al.
5,865,613 A 2/1999 Rajewski
6,474,250 B1 * 11/2002 Penterson ..... F23D 1/02 110/261
8,967,995 B1 3/2015 Griffin et al.
2007/0231758 A1 10/2007 Harless
2007/0292811 A1 12/2007 Poe et al.
2010/0291492 A1 11/2010 Poe et al.
2012/0015308 A1 1/2012 Hong et al.
2014/0370448 A1 * 12/2014 Aldrich ..... F23G 7/085 431/202
2015/0037742 A1 2/2015 Malm et al.
2015/0050603 A1 * 2/2015 Griffin ..... F23G 7/085 431/5
2015/0354815 A1 * 12/2015 Bacon ..... F23G 7/085 431/5
2017/0370579 A1 12/2017 Johnson et al.
2019/0024889 A1 1/2019 Bussman et al.

OTHER PUBLICATIONS

International Search Report and Written Opinion for PCT/US2020/032012 dated Jul. 29, 2020, 7 pages.

* cited by examiner

*Primary Examiner* — Jason Lau
(74) *Attorney, Agent, or Firm* — Foley & Lardner LLP

(57) ABSTRACT

This disclosure presents a clean burning flare stack, or gas flare, especially the tip portion thereof. The gas flare tip is air assisted to ensure clean burning. The disclosed gas flare tip provides smokeless clean burning of released gases. For example, the gas flare tip burns the released gases in a lean burning condition such that sufficient air is supplied to the surges of gases. In addition, the gas flare tip, by using a low pressure blower mixing chamber, is capable of handling low pressure gases and high pressure gases. As such, different flow rates may be provided to the gas flare tip when different amounts of low pressure and high pressure flammable gases are mixed with sufficient blower air to provide a clean burning condition. The disclosed smokeless gas flare is thus environmentally friendly and aesthetically appealing.

8 Claims, 4 Drawing Sheets

CLEAN BURNING GAS FLARE TIP

FIELD

This disclosure relates to a gas combustion device.

BACKGROUND

Petroleum refineries, petrochemical plants, natural gas processing plants, and other gas or chemical process plants face unexpected gas pressure surges, for example, as caused by local valve failure, raw gas production, or accidents preventing proper delivery/transfer/consumption as designed. To address such accidental gas pressure increases, a flare stack, or gas flare, is used to burn off excess gases. The gas flare can thus protect the connected pressure vessels or pipes from over-pressuring due to unplanned operational upsets. It is very common for pressure relief valves to automatically release gas when plant equipment is over-pressurized. Such released gases and/or liquid will be burned off when they exit the gas flare that includes an on-going pilot flame.

The amount of gases flared may cause environmental concerns, especially so if a large amount of released gases cannot be completely burned into carbon dioxide. For example, if the gases include methane, incomplete burning may release methane directly into the atmosphere, causing greater negative impact to the environment than carbon dioxide alone. Soot or smoke, as well as other solid particles, may also be released if the burning is incomplete. Incomplete burning may also subject the gas flare facilities to legal liabilities due to environmental regulations.

SUMMARY

This disclosure presents a clean burning flare stack, or gas flare, especially the tip portion thereof. The tip portion is air assisted to ensure clean burning to reduce or completely eliminate smoke. The disclosed gas flare tip provides smokeless clean burning of released gases. For example, the gas flare tip burns the released gases in a lean burning condition such that sufficient air is supplied to surges of gases. In addition, the flare tip is capable of handling both low and high pressure gases that have forced open relief valves. As such, different flow rates may be provided to the gas flare tip when different amounts of low pressure and high pressure flammable gases are mixed to provide a clean burning condition. The disclosed smokeless gas flare is thus environmentally friendly and aesthetically appealing.

The disclosed clean burning flare stack uses one flare assembly that may attain 98% or greater VOC destruction efficiency for both low pressure tank vapor gas and high pressure emergency vent gas by use of separate low pressure risers and at least one high pressure riser (thus the flare stack uses a "dual pressure" configuration). This dual pressure flare stack may eliminate the need for a second separate flare stack for a tank battery facility and the associated construction costs. In some embodiments, the disclosed flare stack may control liquids found in the waste gas stream with a scrubber pot located at the base completed with a liquid sight glass, level switch, and liquid evacuation pump (e.g., pneumatic diaphragm or electric). In some embodiments, different options may be used for configuring the disclosed clean burning flare stack, including continuous or intermittent ignition, flow activated ignition, flow detection, mass flow measurement, flame detection via flame rod or thermocouple, data logging, flame arrestors, and/or custom guy wire systems.

In a first general aspect, a clean burning gas flare tip includes a low pressure blower mixing chamber enclosing at least one high pressure riser and a number of low pressure risers. The low pressure risers have openings below an opening of the at least one high pressure riser. The clean burning gas flare tip further includes a low pressure gathering chamber below the low pressure blower mixing chamber. The low pressure gathering chamber may be in fluid communication with the number of the low pressure risers. The clean burning gas flare tip further includes an air blower fluidly coupled with the low pressure blower mixing chamber at a blower inlet. The air blower may supply blower air to mix with flammable gases from both the at least one high pressure riser and the plurality of low pressure risers for clean burning.

In one specific aspect, the blower inlet may be below the openings of the low pressure risers.

In another specific aspect, the clean burning gas flare tip further includes a number of flame tabs extending from an opening of the low pressure blower mixing chamber. In some embodiments, the clean burning gas flare tip further includes a pilot shoot that includes a pilot flame opening adjacent one or more of the flame tabs for providing a pilot flame.

In yet another specific aspect, the high pressure riser may further include one or more straightening vanes extending radially from an outer wall of the high pressure riser for regulating gas flow directions inside the low pressure blower mixing chamber. For example, the straightening vanes may regulate directions of both the flows of air and flammable gases (both low and high pressures). The regulation may depend on the flow rate of the air and gases. The hydrocarbon cases often have a higher density than the incoming air, thus when the incoming air flow rate is relatively low, the heavier gases will sink downward to entrain with the incoming air and the overall flow direction may be downward. However, when air is supplied at a high flow rate, the upward air may entrain with the gases and cause the overall flow direction pointing upward. In a balance situation, the air and gases may be entrained inside the low pressure mixing chamber without substantial overall movement when the mixed portion is burned away as quickly as the incoming gases. In some embodiments, flame tabs may be used on the inner diameter of the low pressure flare portion, such as the low pressure risers or the low pressure blower mixing chamber to draw in air and mix the air with low pressure gas streams in order to assist smokeless burning.

In one specific aspect, the air blower may be configured to provide the blower air at a flow rate to produce a lean burning condition when mixed with the flammable gases from both the at least one high pressure riser and the plurality of low pressure risers up to a stoichiometric ratio, at which the flammable gases are completely burned off. In some embodiments, a controller communicating with a sensor measuring an incoming amount of flammable gases may be used to perform a close loop control for adjusting the blower air flow rate as needed. In other embodiments, the controller may be communicating with a temperature sensor for determining the burning condition at the clean burning gas flare tip for determining a burning condition thereof. Different sensors at different locations may be implemented.

In another specific aspect, the low pressure gathering chamber receives low pressure flammable gases at a low pressure inlet below the low pressure blower mixing chamber.

In yet another specific aspect, the low pressure blower mixing chamber receives the blower air at a pressure equal to or higher than that of the flammable gases from both the at least one high pressure riser and the plurality of low pressure risers.

In a second general aspect, a low pressure blower mixing chamber is disclosed for mixing flare gases at a clean burning gas flare tip. The low pressure blower mixing chamber includes at least one high pressure riser; one or more low pressure risers below the at least one high pressure riser; and a blower inlet for receiving pressurized blower air. The blower inlet may be positioned below openings of the one or more low pressure risers.

In one specific aspect, the one or more low pressure risers comprise six cylindrical rubes evenly distributed around the at least one high pressure riser.

In another specific aspect, the low pressure blower mixing chamber may further include multiple flame tabs extending from an opening of the low pressure blower mixing chamber. In some embodiments, the opening of the low pressure blower mixing chamber is above the at least one high pressure riser.

In yet another specific aspect, the low pressure blower mixing chamber of claim 9, further includes an inner core having a central tube and a flange extending radially from the central tube, the and a plurality of surrounding tubes extending from the flange and substantially parallel to the central tube, wherein the central tube forms the at least one high pressure riser and the plurality of surrounding tubes forms the one or more low pressure risers.

In some embodiments, the low pressure blower mixing chamber may further include an external housing sealingly surrounding the inner core at the flange. The blower inlet may be an opening at the external housing.

In one specific aspect, the inner core further include multiple straightening vanes radially extending from the central tube and dividing the plurality of surrounding tubes into individual risers with the external housing above the blower inlet.

In a third general aspect, a flare stack includes a base supplying flammable gases and blower air; a tip receiving the flammable gases and the blower air, the tip having a low pressure blower mixing chamber and a low pressure gathering chamber; and a riser transferring a high pressure portion of the flammable gases to the tip. The riser may have a high pressure riser opening below an opening of the low pressure blower mixing chamber of the tip. The flare stack further includes a first riser transferring a low pressure portion of the flammable gases to the low pressure gathering chamber of the tip. The low pressure gathering chamber is configured to situate below the low pressure blower mixing chamber. A second riser may be used to transfer the blower air to the low pressure blower mixing chamber of the tip. A number of low pressure risers may extend from the low pressure gathering chamber into the low pressure blower mixing chamber. The low pressure risers may have openings below the high pressure riser opening.

In one specific aspect, the base of the flare stack further includes an air compressor configured to provide the blower air. The air compressor may include a controller operable to provide the blower air at a flow rate that produces a lean burning condition when mixed with the flammable gases from both the riser and the plurality of low pressure risers up to a stoichiometric ratio. The controller may receive measurement signals from one or more sensors installed in the tip.

In another specific aspect, the low pressure blower mixing chamber may further include an inner core having a central tube and a flange extending radially from the central tube. The low pressure blower mixing chamber may also include multiple surrounding tubes that are extending from the flange and substantially parallel to the central tube. The central tube may form the at least one high pressure riser. The surrounding tubes may form the one or more low pressure risers. The low pressure blower mixing chamber further includes an external housing sealingly surrounding the inner core at the flange. The blower inlet is an opening at the external housing. The inner core further includes straightening vanes radially extending from the central tube and dividing the surrounding tubes into individual risers with the external housing above the blower inlet.

In yet another specific aspect, the base may further include one or more relief valves separating the high pressure portion of the flammable gases from the low pressure portion of the flammable gases.

In one specific aspect, the flare stack may further include a pilot shoot delivering a pilot gas to the tip. The pilot shoot can provide an on-going flame for lighting up the flammable gases in the tip.

Other aspects, features, and advantages will become apparent from the following detailed description when taken in conjunction with the accompanying drawings, which are part of this disclosure and which illustrate, by way of example, principles of the disclosures disclosed.

DESCRIPTION OF THE FIGURES

The accompanying drawings facilitate an understanding of the various embodiments.

Like reference numerals indicate like elements.

DETAILED DESCRIPTION

At a high level, a gas flare tip disclosed herein enables clean burning and reduces and eliminates black smoke, soot, or other contaminants due to incomplete burning. The disclosed gas flare tip is configured to handle flammable gases at both low pressures and high pressures, as regulated and protected by pressure relief valves. FIGS. 1A, 1B, 2A, 2B, and 3A, and 3B illustrate an embodiment of a flare stack in detail.

Figure 1A:
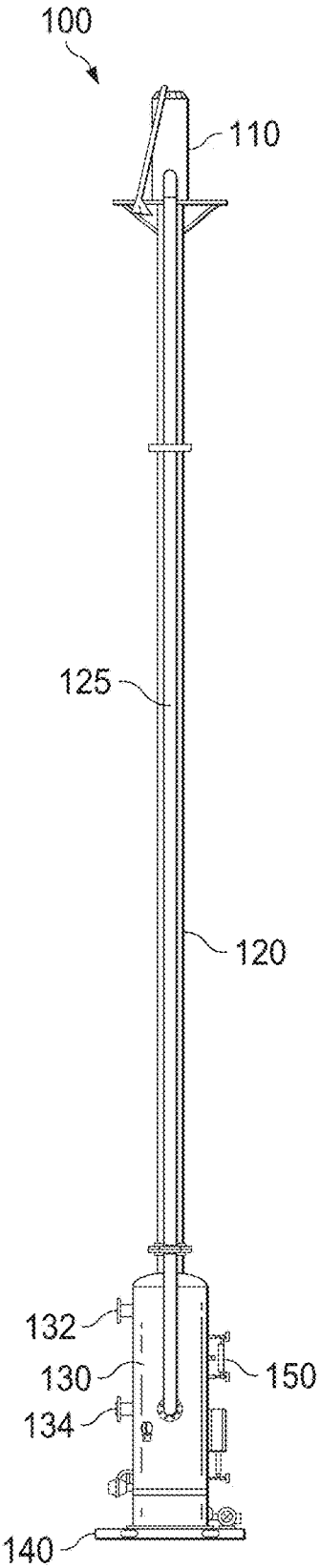
FIGS. 1A and 1B are respective front and side views of a flare stack of an example embodiment of this disclosure.
Figure 1B:
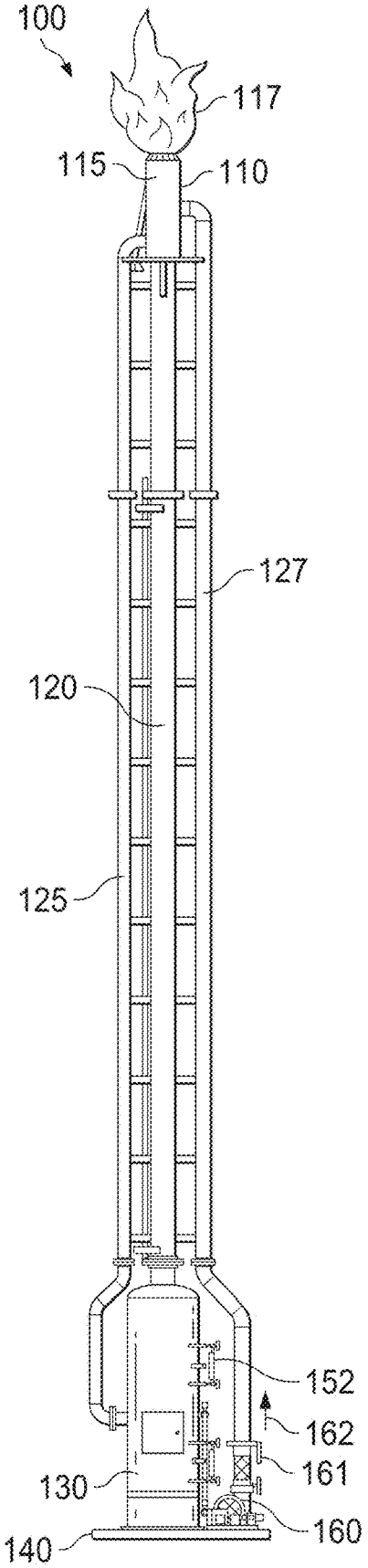
Figure 2B:
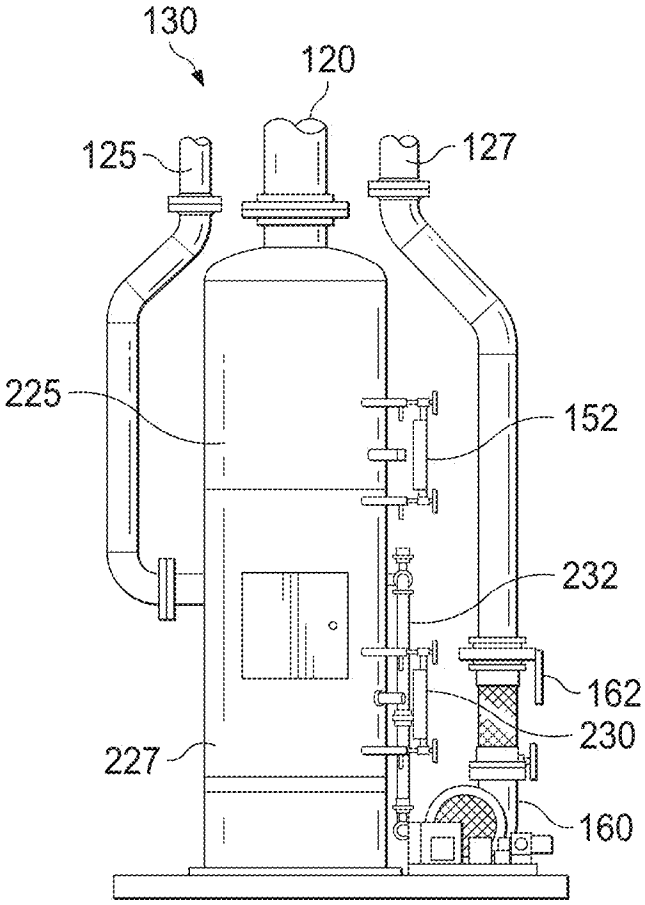
FIGS. 2A and 2B are respective local front and side views of the base of the flare stack shown in FIGS. 1A and 1B.
Figure 2A:
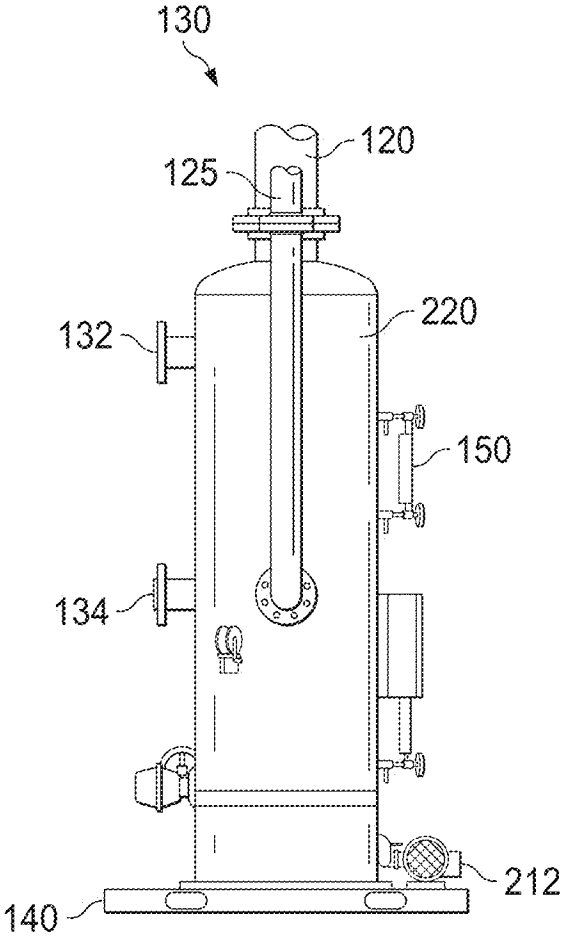
Figure 3A:
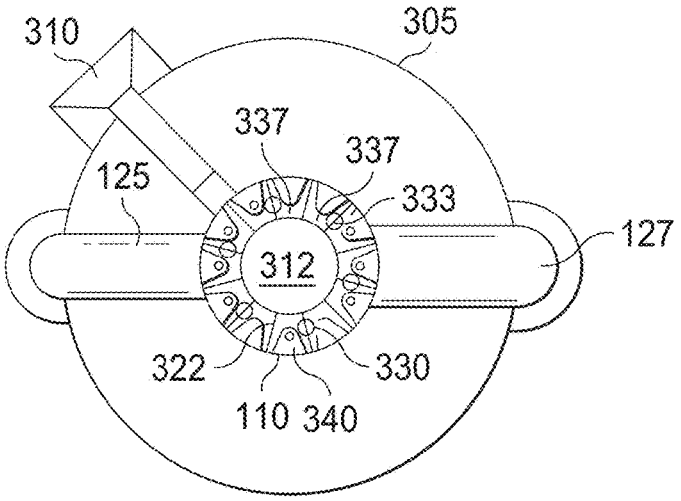
FIGS. 3A and 3B are respective top and side views of the clean burning gas flare tip of the flare stack shown in FIGS. 1A and 1B.
Figure 3B:
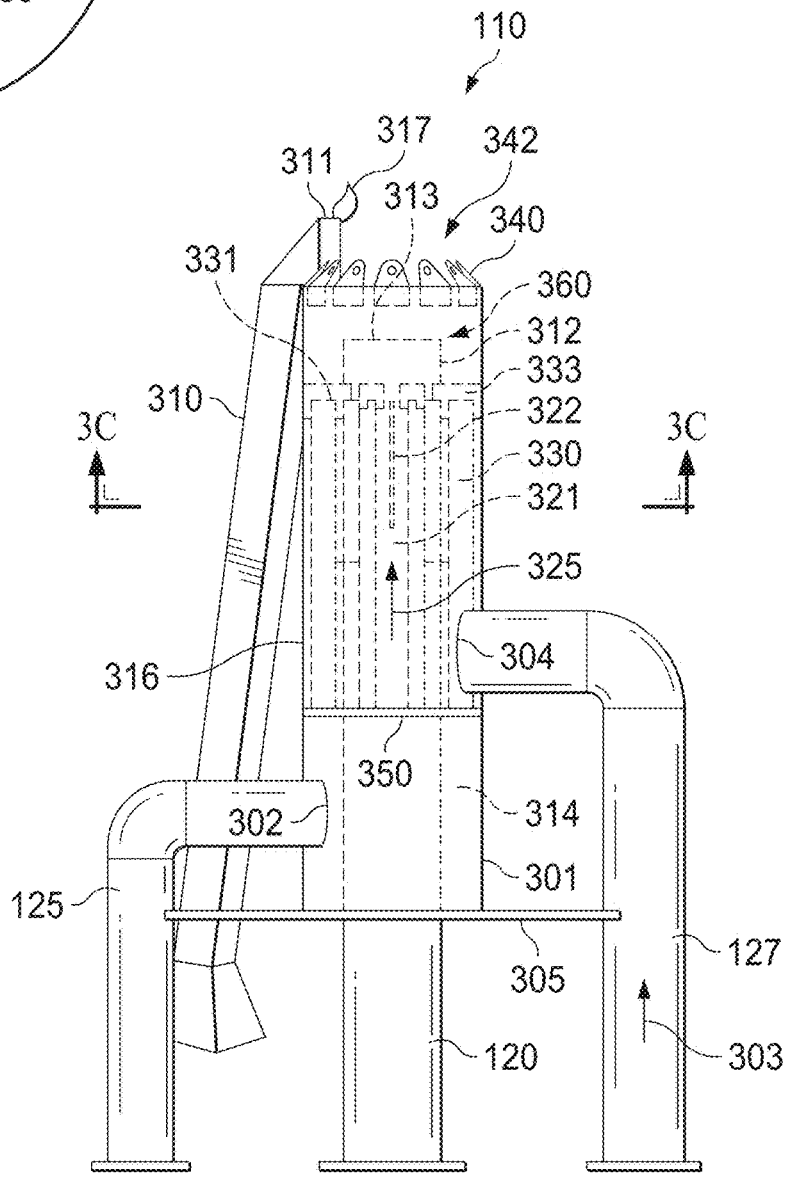

FIGS. 1A and 1B are respective front and side views of an exemplary embodiment flare stack 100. The flare stack 100 includes a base 130 and a tip 110 connected by one or more risers, such as the central riser 120 and a side riser 125. FIGS. 2A and 2B illustrate front and side views, respectively, of the base 130 of the flare stack 100. FIGS. 3A and 3B illustrate top and side views, respectively, of the clean burning gas flare tip 110 of the flare stack 100. In operation, the base 130 supplies the tip 110 with flammable gases 115 and blower air 162. The tip 110 includes a low pressure blower mixing chamber 316 and a low pressure gathering chamber 314. The low pressure gathering chamber 314 is located below the low pressure blower mixing chamber 316.

The flammable gases are supplied at both high pressures and low pressures. The high pressure portion of the flammable gases are transferred by a riser 120 from the base 130 to the tip 110. The tip 110 burns the flammable gases 115 in a clean, smokeless manner such that its flames 117 do not include apparent unburnt dark particles. In some embodiments, the base 130 further includes one or more relief valves 150 or 152 (FIGS. 1A & 1B) that separate the high-pressure portion of the flammable gases from the low-pressure portion of the flammable gases.

In the embodiment illustrated in FIGS. 3A & 3B, the riser 120 has a high pressure riser opening 313 below an opening 342 of the low pressure blower mixing chamber 316 of the tip 110. The risers connecting the base 130 to the tip 110 include a first riser 125 transferring a low pressure portion of the flammable gases to the low pressure gathering chamber 314 of the tip 110. The risers also include a second riser 127, which transfers the blower air to the low pressure blower mixing chamber 316 of the tip 110. A number of low pressure risers 330 extend from the low pressure gathering chamber 314 into the low pressure blower mixing chamber 316. In some embodiments, the low pressure risers 330 may have an opening of about 2" in diameter; although the sizes may vary. In some other implementations, the opening diameter of the low pressure risers 330 could be greater than 2", such as 3", or smaller than 2", such as 1", depending on flow rate, size of the tip 110, and other factors.

In the embodiments illustrated, six low pressure risers 330 are shown to be evenly distributed around the high pressure riser 312. In other embodiments, however, different configurations may be implemented, for example, a different number of low pressure risers 330 may be used, each having a different diameter, or distributed in an uneven manner. The multiple low pressure risers 330 have openings 331 below the high pressure riser opening 313. In some embodiments, the high pressure riser opening 313 may be about 10", although other sizes may be used.

Referring back to In FIG. 1A, in some embodiments the base 130 includes an installation plate 140 for securing the flare stack 100 onto the ground or other support surface. The base 130 may further include a first port 132 and a second port 134 for receiving flammable gases from various sources and a pressure relief valve 150 for allowing a portion of the low pressure flammable gases, upon the increase of pressure, to be transferred to the high pressure riser 120. In the side view shown in FIG. 1B, the base 130 may further include a second pressure relief valve 152, or include additional pressure relief valves not shown in the current illustrations, to protect against sudden pressure increase and regulate the apportionment between high pressure and low pressure flammable gases.

In some embodiments, the base 130 also include an air compressor 160, which may be controlled by a blower air valve 161 for supplying blower air 162 to the tip 110. In some embodiments, the air compressor 160 includes a controller that is operable to provide the blower 160 with the blower air 162 at a flow rate that produces a lean burning condition when mixed with the flammable gases at the tip 110. This will require compensation for a sudden burst of high pressure flammable gases in unplanned conditions. The air provided would allow for complete burning of both the low-pressure and high-pressure portions of the flammable gases up to a stoichiometric ratio. For example, the controller may receive measurement signals from one or more sensors installed at the tip 110. The one or more sensors may include a flow rate sensor for determining the amount of flammable gases, a temperature sensor for determining the burning situation at the tip 110, or other sensors that are capable of reflecting the burning condition 110.

In some embodiments, the low pressure blower mixing chamber 316 includes an inner core 360 (FIG. 3B). The inner core 360 may have a central tube 312, a portion of the high pressure riser 120 extending into the tip 110. The inner core 360 may also include a flange 350 that extends radially from the central tube 312. The inner core 360 may further include multiple surrounding tubes 330 that extend from the flange 350. The multiple surrounding tubes 330 may be substantially parallel to the central tube 312. The surrounding tubes 330 may be used as low-pressure risers. Low-pressure blower mixing chamber 316 may further include an external housing 301 that is sealingly surrounding the inner core 360 at the flange 350. The blower inlet may be an opening 304 and external housing 301. The inner core 360 may further include a number of straightening vanes radially extending from the central tube 312. The straightening vanes 322 may divide the multiple surrounding tubes 330 into individual risers 337 with the external housing 301 above the blower inlet 304. In some implementations, the blower inlet is connected with an immediate tubular portion that forms a perpendicular angle with the housing 301.

Referring to FIG. 2A, the base 130 may include an additional or supplementary air pump 212. The supplementary air pump 212 will work together with the air pump 160 when additional blower air 162 is required. In some embodiments, the air pumps 212 and 160 may be formed as a single pump, or formed by multiple pumps, to provide sufficient power and/or flow rate for the blower air 162. The base 130 may include a gas storage tank 220 for storing and/or buffering flammable gases before they are sent to the tip 110 for burning. In FIG. 2B, the gas tank 220 may include two compartments: a compartment 225 for high-pressure gases and another compartment 227 for low-pressure gases. In some embodiments, the base 130 further includes one or more relief valves 152 that separates the high-pressure portion of the flammable gases in the tank 225 from the low-pressure portion of the flammable gases in the tank 227. The high-pressure gas tank 225 may receive high-pressure gases at the inlet 132. The low pressure gas tank 227 receives low-pressure gases at the inlet 134. In some embodiments, pressure meters 230 may provide a reading of the amount of low-pressure gases stored in a low-pressure gas tank 227. Other tubes or connections 232 may enable further manipulation, storage, or transfer of the flammable gases in the gas tanks 225 and 227.

Turning now to FIG. 3A that shows the top view of the clean burning gas flare tip 110, more details are shown of the low-pressure blower mixing chamber 316 and other surrounding components. The low-pressure blower mixing chamber 316 includes at least one high pressure riser 312 and multiple low-pressure risers 330. Although illustrated as a single high pressure riser 312, two or more high-pressure risers may be installed in its place. The multiple low-pressure risers 330 have openings below the opening of the at least one high pressure riser 312. The multiple low-pressure risers are in fluid communication with a low-pressure gathering chamber 314, such that the low-pressure gathering chamber 314 provides low-pressure flammable gases to the low-pressure blower mixing chamber 316. The air blower 160, as illustrated, is fluidly coupled with a low-pressure blower mixing chamber and the blower inlet 304 that is near the bottom of the low-pressure blower mixing chamber 316.

Figure 3C:
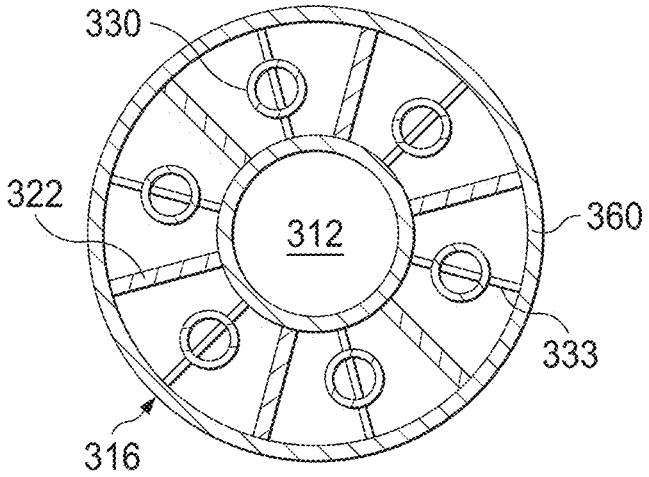
FIG. 3C is a local cross sectional top view of the clean burning gas flare tip.

During operation, a large amount of blower air 162 is supplied into the low-pressure blower mixing chamber 316 such that the flammable gases therein are mixed and surrounded by large amount of air for clean burning. Because the opening 342 is higher than the opening 313 of the high pressure riser 312, the external housing 301 may also function as a wind guard. In some embodiments, the external housing 301 may have an opening of a diameter of 18". The opening 342 of the low-pressure blower mixing chamber may include multiple flame tabs 340 for regulating the flame. As shown in FIG. 3B, the tip 110 may further include a pilot shoot 310 that has a pilot flame opening of 311 adjacent one or more of the multiple flame tabs 340. FIG. 3C is a local cross sectional top view of the clean burning gas flare tip, for example, near the top of the low pressure risers 330.

Figure 4:
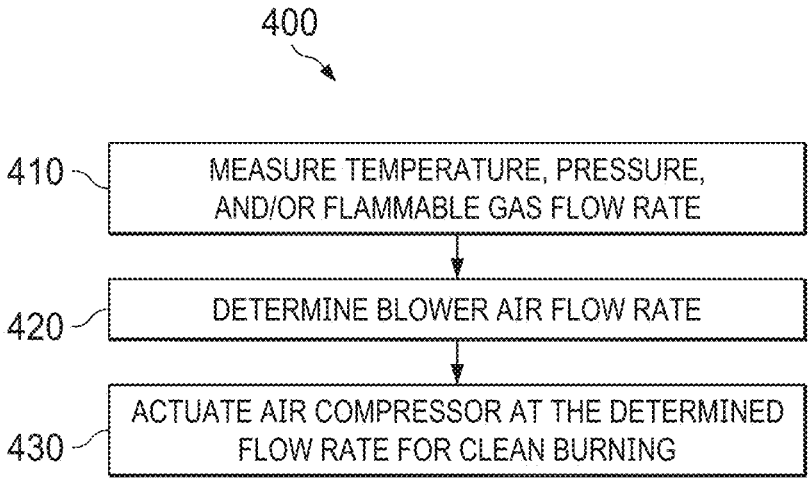
FIG. 4 is a flow chart illustrating a control scheme for maintaining a smokeless, clean burning condition at the gas flare tip shown in FIGS. 3A and 3B.

FIG. 4 is a flow chart 400 illustrating a control scheme for maintaining a smokeless, clean burning condition at the gas flare tip shown in FIGS. 3A and 3B. At step 410, the flare stack having a smokeless or clean gas flare tip may measure the temperature, the pressure, the flammable gas flow rate, and other aspects of the operation. For example, one or more sensors may be installed at a gas flare tip. In some implementations, the measurements may be based on previous testing and are not measured in all operations.

At step 420, the controller for an air compressor or an air blower determines a flow rate for the blower air to be supplied to the gas flare tip. For example, such determination may be based on the condition of current burning or the measured flow rate of the flammable gases. At step 430, the controller, based on the determined flow rate for the blower area, may actuate the air compressor at the determined flow rate for clean and smokeless burning. In some embodiments, the controller may perform a closed-loop control to address unexpected surge in the flammable gases. In some other embodiments, the controller may be operating in an open-loop control, for example, to provide lower air multiple times of what may be needed to offset is sufficient air supply situations.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms. "And" and "or" may be used interchangeably unless specifically required otherwise.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the disclosure(s), and alterations, modifications, additions and/or changes can be made thereto without departing from the scope and spirit of the disclosed embodiments, the embodiments being illustrative and not restrictive.

Furthermore, disclosures herein have been described in connection with what are presently considered to be the most practical and preferred embodiments and it is to be understood that the disclosure is not to be limited to the specifically disclosed embodiments, but on the contrary, is intended to cover various modifications and equivalent arrangements included within the spirit and scope of the disclosure(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A clean burning gas flare tip comprising:

a mixing chamber having an upper opening and enclosing at least one high pressure riser and a plurality of low pressure risers, wherein the plurality of low pressure risers has openings below an opening of the at least one high pressure riser;

a combustion zone defined above the upper opening of the mixing chamber;

a gathering chamber in fluid communication with the plurality of the low pressure risers, the gathering chamber separated from the mixing chamber by a flange forming the bottom of the mixing chamber; and an air blower fluidly coupled with the mixing chamber at a blower inlet, the air blower supplying blower air to mix with the flammable gases from both the at least one high pressure riser and the plurality of low pressure risers, wherein the plurality of low pressure risers are configured to conduct flammable gases at a first pressure and the at least one high pressure riser is configured to conduct flammable gases at a second pressure, the second pressure being greater than the first pressure, and wherein the clean burning gas flare tip is configured to combust flammable gases from the plurality of low pressure rises and from the at least one high pressure riser within the combustion zone outside of the mixing chamber.

2. The clean burning gas flare tip of claim 1, wherein the blower inlet is below the openings of the plurality of low pressure risers.

3. The clean burning gas flare tip of claim 1, further comprising a plurality of flame tabs extending from the upper opening of the mixing chamber.

4. The clean burning gas flare tip of claim 3, further comprising a pilot shoot having a pilot flame opening adjacent one or more of the plurality of flame tabs for providing a pilot flame.

5. The clean burning gas flare tip of claim 1, further comprising one or more straightening vanes extending radially from an outer wall of one of the at least one high pressure riser for regulating gas flow directions inside the mixing chamber.

6. The clean burning gas flare tip of claim 1, wherein the air blower is configured to provide the blower air at a flow rate to produce a lean burning condition when mixed with the flammable gases from both the at least one high pressure riser and the plurality of low pressure risers up to a stoichiometric ratio.

7. The clean burning gas flare tip of claim 1, wherein the gathering chamber receives flammable gases at an inlet below the mixing chamber.

8. The clean burning gas flare tip of claim 1, wherein the mixing chamber receives the blower air at a pressure equal to or higher than the second pressure.

* * * * *